United States Patent [19]

Rasch

[11] Patent Number: 4,775,602

[45] Date of Patent: Oct. 4, 1988

[54] METALLIC COATING OF IMPROVED LIFE

[75] Inventor: Lyle T. Rasch, Fairfield, Ohio

[73] Assignee: General Electric Company, Cincinnati, Ohio

[21] Appl. No.: 69,998

[22] Filed: Jul. 6, 1987

[51] Int. Cl.[4] ..... B32B 15/01

[52] U.S. Cl. ..... 428/668; 29/402.18; 427/142; 427/328; 428/609; 428/614; 428/680

[58] Field of Search ..... 428/668, 680, 609, 614; 427/328, 142, 304, 305; 29/402.18

[56] References Cited

U.S. PATENT DOCUMENTS

| | | | |
|---|---|---|---|
| 3,922,396 | 11/1975 | Speirs et al. | 427/328 |
| 4,004,047 | 1/1977 | Grisik | 427/142 |
| 4,098,450 | 7/1978 | Keller et al. | 228/119 |
| 4,249,963 | 2/1981 | Young | 148/16 |
| 4,285,459 | 8/1981 | Baladjanian et al. | 29/402.18 |
| 4,381,944 | 5/1983 | Smith, Jr. et al. | 29/402.18 |
| 4,478,638 | 10/1984 | Smith, Jr. et al. | 75/255 |

OTHER PUBLICATIONS

Ser. No. 056,175 S. Ferrigno, et al—Inventors Filing Date: 6/1/85.

*Primary Examiner*—Wayland Stallard
*Attorney, Agent, or Firm*—Derek P. Lawrence

[57] ABSTRACT

A method for improving oxidation resistance life of a metallic coating deposited on a metallic alloy including boron treats the alloy to reduce the boron prior to depositing the coating. The article provided by using a diffusion coating method has a diffusion zone between the coating and the alloy substrate characterized by the substantial absence of boride needles traversing the diffusion zone from the coating into the alloy.

15 Claims, 1 Drawing Sheet

METALLIC COATING OF IMPROVED LIFE

This invention relates to metallic coatings on a metallic surface and, more particularly, to a method for improving the oxidation resistance life of such coatings and to the resulting article.

BACKGROUND OF THE INVENTION

The application of certain protective metallic coatings to alloy surfaces, particularly of the nickel base or cobalt base type are described in such U.S. Pat. Nos. as 3,540,878—Levine, et al, 3,598,638—Levine (forms of which are sometimes referred to as CODEP coating) and 3,976,436—Chang (representative of those types of coatings sometimes referred to as the MCrAl class of coatings). In addition, use of flouride ions for cleaning or treatment of metallic surfaces or materials is described in U.S. Pat. Nos. 4,098,450—Keller, et al and 4,249,963—Young. The disclosures of all of the above identified patents are hereby incorporated by reference.

The development of advanced gas turbine engines has led to the design of certain hot section parts intended to operate under increasingly more strenuous environmental conditions, for example conditions of oxidation. It is common practice in the art to improve the oxidation resistance of the surfaces of such parts through the application of metallic coatings, for example of the type identified above. The result can be improved operating life of the coated part, which can be very expensive to replace and costly to repair.

SUMMARY OF THE INVENTION

It is a principal object of the present invention to provide a method for improving the oxidation resistance life of a metallic coating applied to a metallic substrate.

Another object is to provide a method for improving the oxidation resistance life of high temperature operating metallic coatings applied to surfaces of nickel base or cobalt base superalloy articles.

Still another object is to provide a metal coated alloy article of improved oxidation resistance.

These and other objects and advantages will be more fully understood from the following detailed description, the drawing and the specific examples, all of which are intended to be typical of rather than in any way limiting on the scope of the present invention.

Briefly, the present invention provides a method for improving the oxidation resistance life of the combination of a metallic coating deposited on a metallic portion surface which includes the element boron in its composition. The method comprises the steps of treating the surface portion to reduce its boron content up to a depth of about 0.005" to provide a treated surface. Thereafter, a metallic coating is deposited on the treated surface. In one form, such treatment comprises exposing the surface to gaseous fluoride ions which will react with the boron in the surface to form a gaseous boron compound which thereafter is emitted from the surface.

In a more specfic form, the method of the present invention provides improving the oxidation resistance life of the combination of a metallic coating deposited on an article surface which includes a repaired portion. For example, such a repaired portion comprises the article alloy itself, which includes the element boron, and a metallic repair material, typically in a recess or crack in the article, the repair material being different in composition from that of the article alloy. The repair material is bonded to the article alloy. The method comprises treating the repaired portion to reduce the boron content of the repair material thereby providing a treated surface, and then depositing the metallic coating on the treated surface.

The coated article of the present invention which comprises an alloy surface based on Ni and/or Co and which also includes B, has a diffusion zone characterized by the significantly reduced amount of boride needles, for example chromium boride, traversing the diffusion zone from the coating into the alloy surface.

DESCRIPTION OF THE PREFERRED EMBODIMENTS

Because of the complexity in the design and difficulty in the manufacture of high temperature operating gas turbine engine parts, particularly those which rotate in a high temperature, highly oxidizing atmosphere, generally it is less expensive to repair the part than to replace it. As a result, there has developed a relatively broad body of technology relating to the repair of such parts or articles. One method is identified in the above incorporated Keller, et al U.S. Pat. No. 4,098,450. Other repair methods involving metallic powders or powder mixtures, useful in such method, are described in U.S. Pat. No. 4,381,944—Smith, et al and in co-pending application Ser. No. 056,175—Ferrigno, et al, entitled "Alloy Power Mixture for Treating Alloys", filed June 1, 1987. The disclosure of the Smith, et al Patent and the Ferrigno, et al application are hereby incorporated herein by reference.

Figure 1:
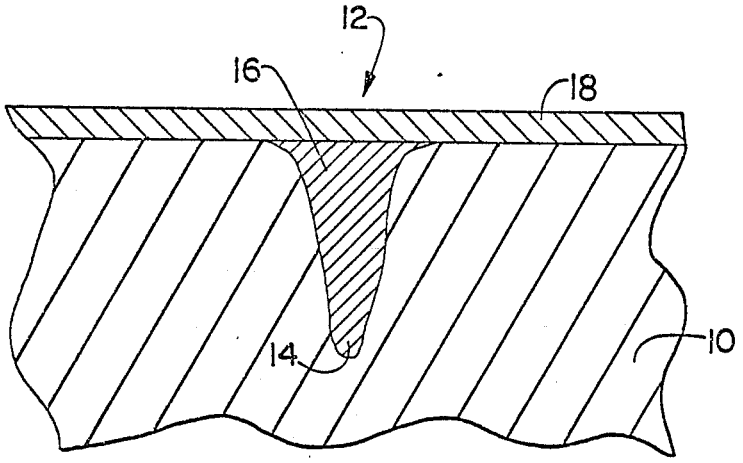
FIG. 1 is an enlarged, sectional, diagrammatic view of a fragment of a metallic material including a repaired portion.

In the evaluation of repair technology and the repair of gas turbine engine high temperature articles of the type manufactured from nickel base or cobalt base superalloys, it was observed that the above identified aluminide type coating, sometimes referred to as CODEP coating and more fully described in the above incorporated Levine, et al and Levine Patents, deteriorated under oxidizing conditions significantly more rapidly in some cases than in others. Such deterioration was more prevalent when such coating was applied over a repaired portion of a nickel base or cobalt base superalloy article which had been repaired using a meterial of composition different than the superalloy. Such a combination of metallic materials and coatings are shown in FIG. 1 of the drawing. In that Figure, an alloy article 10 includes a repaired portion shown generally at 12 comprising a recess or crevice such as a crack 14 in article 10, a metallic repair material 16 bonded in recess 12 and a metallic coating 18 deposited over the repaired portion 12.

During the evaluation of the present invention as it relates to the type of metallic combination shown in FIG. 1, it was recognized that the oxidation life of a metallic coating, such as one which includes the element of aluminum (as in an aluminide coating) could be improved by at least two times and in some cases ten times through the depletion of the element boron from surface of the repaired portion prior to application of the metallic coating. Because the type of alloy generally referred to as superalloys or the repair alloy or both includes the element chromium, boron in the surface frequently is in the form of chromium boride phases. The present invention relates to treating the surface portion of the alloy; therefore, reactions are surface phenomena, affecting material within 0.005" of the surface, and generally within about 0.002" of the surface. Reduction of such boride phases before application of a metallic coating is significantly beneficial for at least two reasons: first, removing such stable precipitates from the surface reduces the number of crack initiation sites, promoting good oxide adherence during thermal cycling: second, it appears to promote the formation of a more effective, continuous diffusion zone. It was observed that this treatment allowed the aluminum oxide protective film to regenerate itself at elevated temperatures, for example in the range of about 2050°-2100° F.

During the evaluation of the present invention, studies were conducted to more fully understand the effect of surface related phenomena. One such study involved a gas turbine engine airfoil made of a cobalt base superalloy sometimes referred to as WI-52 as the structural or base alloy. The nominal composition, by weight, of WI-52 alloy is 21% Cr, 11% W, 2% Cb, 2% Fe, 0.45% C with the balance essentially Co and incidental impurities. Such an airfoil material was prepared using a repair sequence developed for such an alloy: the surface was grit blasted with aluminum oxide media and chemically treated to remove a diffused aluminide coating, after which it was exposed to fluoride ions and vacuum cleaned. With the base material thus prepared, a cobalt base repair alloy identified as SA-1 alloy, more fully defined in the above incorporated, co-pending Ferrigno, et al application, was applied. The nominal composition of SA-1 alloy is, by weight, 28% Cr, 4.5% W, 10% Ni, 1% Al, 1.5% Ti, 1.5% Ta, 1% B, 0.3% Si, 0.15% Zr, with the balance Co and incidental impurities.

The SA-1 alloy was applied to random surface areas of the airfoil, after which the specimen was processed through the brazing/diffusion cycle developed for SA-1 alloy: brazing in the range of about 2150°-2250° F. for about one-half hour followed by diffusion in the range of 2000°-2150° F. for about 8-15 hours. The brazed areas on the WI 52 base alloy were benched with a carbide cutter to remove the tantalum/titanium rich surface region, and the airfoil was then sectioned into multiple pieces for further evaluation and for the establishment of baseline samples. Some of the pieces were exposed to a fluoride ion cycle prior to the application of an aluminide coating. Such a cycle involved exposing the samples to an atmosphere of fluoride ions in a manner described in the above incorporated U.S. Pat. Nos. 4,249,963—Young and 4,098,450—Keller, et al. In this example the temperature of exposure was about 1750° F., in the range of about 1700°-1800° F., for about 1-2 hours. The fluoride ions were from hydrogen fluoride gas in a gaseous mixture at a concentration of about 5-15 volume percent, with the balance hydrogen gas. An aluminide-type coating, sometimes referred to as CODEP coating and more fully described in the above incorporated U.S. Pat. No. 3,540,878—Levine, et al was applied to specimens which had been exposed to the fluoride ion atmosphere, as well as those which had not been so exposed. Involved in such coating application is a diffusion treatment in the temperature range of about 1900°-1950° F., which creates a diffusion zone between the coating and the substrate on which the coating was applied, in this case the SA-1 alloy. This was accomplished to evaluate the interaction and surface phenomena associated with such procedures.

Figure 2:
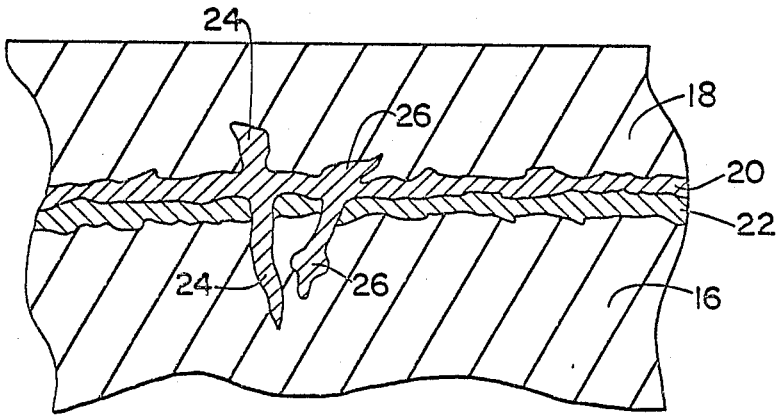
FIG. 2 is a diagrammatic presentation of a photomicrograph of 1000 magnifications of a coated specimen not treated according to the present invention.
Figure 3:
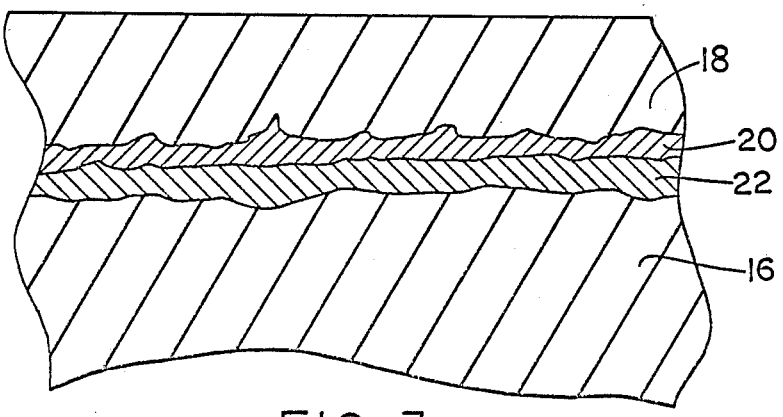
FIG. 3 is a diagrammatic presentation of a photomicrograph at 1000 magnifications of a coated specimen which has been treated according to the present invention.

Micrographic studies of portions of such specimens, as they relate to the present invention, are summarized in the diagrammatic presentations of FIGS. 2 and 3. Such views are fragments of sections taken through the specimens processed as above and observed at 1000 magnifications. With reference to FIGS. 2 and 3, portion 16 is the repair alloy in the form of the above described SA-1 alloy deposited on a WI-52 alloy substrate (not shown). Coating 18 was the CODEP aluminide diffusion coating described above. Involved in the CODEP coating process is a diffusion step which, as it relates to the present invention, generated a diffusion zone which included a chromium boride phase 20 and a tungsten rich phase 22 as a result of those elements being present in the SA-1 repair alloy.

FIG. 2 represents the results of processing of the specimen without exposure of the surface of the SA-1 repair alloy to fluoride ions, according to the present invention, prior to application of the CODEP coating. The presentation of FIG. 3 respresents a specimen which was exposed to fluoride ion treatment, according to the present invention, prior to CODEP coating. Comparison of FIGS. 2 and 3 clearly shows that use of fluoride ion exposure prior to coating, according to the present invention, significantly reduces the capability of the chromium boride phase to generate or precipitate "needles" such as those shown at 24 and 26 in FIG. 2, traversing the diffusion region from the CODEP coating into the SA-1 repair alloy. Such needles are believed to constitute crack initiation sites and a path for oxygen to penetrate from the CODEP coating into the SA-1 repair alloy, thereby promoting oxidation failure. As can be seen from FIG. 3, representative of results of the present invention in which an average of at least about 50% of the needles are eliminated, there is generated a more effective, continuous chromium boride phase 20 adjacent a tungsten rich phase 22 in the diffusion zone between the CODEP coating and the SA-1 repair alloy. It was observed that this allowed an aluminum oxide protective film from the CODEP coating to regenerate itself at elevated temperatures for example, in the range of 2000°-2100° F., indicating a more significant reduction in traversing needles.

As was mentioned above, the present invention provides imporvement in coating life of at least two times. In the case of the use of CODEP coating over SA-1 repair alloy, the multiplier was significantly greater, for example up to 10 times improvement after exposure in the range of 2000°-2100° F.

In this evaluation, it was observed that the general coating thickness and composition was substantially the same with or without the fluoride ion treatment: no meaningful changes were made to the compositions in the near surface region (up to about 0.005"), except for the above described depletion of boron to inhibit the formation of the chromium boride needles described above and shown in FIG. 2. The coating thickness and aluminum content were essentially unaltered by the additional processing. A slight reduction (for example less than two weight percent) in the chromium content was noted, presumably because of the formation of a chromium oxide film during processing.

The present invention, through the reduction of boron within up to about 0.005" of a surface to be coated, removes crack initiation sites which are particularly significant during thermal cycling. Once a substrate is exposed in this manner, oxygen can diffuse relatively rapidly along exposed grain boundaries. Formation of internal cobalt and chromium oxides can then accelerate failure of the aluminide type coating. Although the present invention has been described in connection with specific examples and embodiments, it will be recognized by those skilled in the art that the present invention is capable of various modifications and other embodiments without departing from the scope of the appended claims.

What is claimed is:

1. A method for improving the oxidation resistance life of the combination of a metallic coating deposited on a metallic surface portion which includes the element boron in its composition, comprising the steps of:

treating the surface portion to reduce the boron content of the surface portion up to a depth of about 0.005" to provide a treated surface; and then, depositing the metallic coating on the treated surface.

2. The method of claim 1 in which the treatment of the surface portion includes exposing the surface portion to gaseous fluoride ions with which the boron will react to form a gaseous compound.

3. The method of claim 2 in which:

the gaseous fluoride ions are from a hydrogen fluoride gas in a gaseous mixture;

the concentration of the hydrogen fluoride gas in the mixture is in the range of 5–15 volume percent, with the balance hydrogen gas; and the treatment is conducted at about 1700°–1800° F. for about 1–2 hours.

4. The method of claim 1 in which the metallic coating comprises aluminum.

5. The method of claim 4 in which the coating is of the diffusion aluminide type.

6. The method of claim 1 in which the metallic surface portion is a nickel base or cobalt base repair alloy.

7. The method of claim 6 in which the boron predominantly is in the form of chromium boride in the surface portion.

8. A method for improving the oxidation resistance life of an article having a metallic coating deposited on a metallic surface portion which comprises at least first and second metallic materials different in composition one from the other, the surface portion of the first metallic material being a nickel base or cobalt base superalloy and the second metallic material being a repair alloy which includes the element boron and which is metallurgically bonded to the first metallic material, comprising the steps of:

treating the surface portion at least of the second material to reduce the boron content of the surface portion to a depth of about 0.005" to provide a treated surface; and then, depositing the metallic coating on the treated surface.

9. A method for improving the oxidation resistance life of an article having a metallic coating, including aluminum, deposited on an article surface portion which includes a repaired portion, the repaired portion comprising an article alloy and a metallic repair material different in composition from the article alloy and including the element boron, the repair material being bonded in a recess in the article alloy, comprising the steps of:

treating the repaired portion with gaseous fluoride ions to reduce the boron content of the repair material at the article surface portion up to a depth of about 0.005" to provide a treated surface; and then, depositing the metallic coating on a treated surface.

10. The method of claim 9 including the step of diffusing the deposited coating with the article surface to provide a diffusion zone therebetween.

11. A coated article of improved oxidation resistance comprising:

an alloy surface based on an element selected from the group consisting of Ni and Co and including the element B;

a metallic coating diffused with the alloy surface providing a diffusion zone therebetween;

the diffusion zone being characterized by a significantly reduced amount of boride needles traversing the diffusion zone from the coating into the alloy of the surface.

12. The article of claim 11 treated in accordance with the method of claim 1 and in which the average amount of boride needles traversing the diffusion zone is at least 50% less than the amount existing without the treatment.

13. A repaired article having a repaired portion of improved oxidation resistance, the repaired portion comprising a superalloy structural alloy based on an element selected from the group consisting of Ni and Co, a recess in the structural alloy with a repair alloy therein, the repair alloy comprising the elements B, Cr and W, and a metallic coating diffused with the structural alloy and the repair alloy, wherein:

the repaired portion comprises a diffusion zone, between the metallic coating and the repair alloy, having a substantially continuous chromium boride phase characterized by the significantly reduced amount of chromium boride needles which traverse the diffusion zone from the coating into the repair alloy.

14. The article of claim 13 treated in accordance with the method of claim 8 and in which the average amout of boride needles traversing the diffusion zone is at least 50% less than the amount existing without the treatment.

15. The article of claim 13 wherein there is a tungsten rich phase between the substantially continuous boride phase and the repair alloy.

* * * * *